US005541563A

United States Patent [19]

Leupold

[11] Patent Number: 5,541,563

[45] Date of Patent: Jul. 30, 1996

[54] MAGNET IRON STRUCTURE

[75] Inventor: Herbert A. Leupold, Eatontown, N.J.

[73] Assignee: The United States of America as represented by the Secretary of the Army, Washington, D.C.

[21] Appl. No.: 371,231

[22] Filed: Jan. 11, 1995

[51] Int. Cl.[6] ..... H01F 6/00

[52] U.S. Cl. ..... 335/216; 505/211; 505/213; 505/879

[58] Field of Search ..... 335/216; 174/15.4, 174/15.5, 125.1; 505/211, 212, 213, 230, 231, 232, 704, 705, 879, 884, 885, 886, 887

[56] References Cited

U.S. PATENT DOCUMENTS

| | | | |
|---|---|---|---|
| 3,599,009 | 8/1971 | Parmentier | 365/162 |
| 4,894,360 | 1/1990 | Leupold | 505/1 |
| 4,917,736 | 4/1990 | Leupold | 148/108 |
| 5,075,280 | 12/1991 | Pisharody et al. | 360/119 |
| 5,104,849 | 4/1992 | Shiga et al. | 505/1 |
| 5,113,163 | 5/1992 | Leupold | 335/216 |
| 5,159,219 | 10/1992 | Chu et al. | 310/90.5 |

*Primary Examiner*—Leo P. Picard
*Assistant Examiner*—Raymond M. Barrera
*Attorney, Agent, or Firm*—Michael Zelenka; William H. Anderson

[57] ABSTRACT

A trapped flux, iron structure, which prevents bunching of interior flux lines during an application of a field force, is provided. This iron structure includes a plurality of elongate identical subassemblies, each subassembly having a rod composed of a soft ferromagnetic material and each rod having a superconductive sheath.

5 Claims, 1 Drawing Sheet

MAGNET IRON STRUCTURE

GOVERNMENT INTEREST

The invention described herein may be manufactured, used and licensed by or for the Government of the United States of America without the payment to me of any royalties thereon.

FIELD OF THE INVENTION

The invention described herein generally relates to a magnet iron structure, and in particular relates to a trapped flux, magnet iron structure which has a plurality of elongate rod and respective superconductive sheath subassemblies.

BACKGROUND OF THE INVENTION

A prior art trapped flux, magnet iron structure is described in U.S. Pat. No. 4,917,736, which was issued on Apr. 17, 1990 to the same inventor as the inventor of this application, which is incorporated herein by reference. The prior art magnet iron structure includes an inner portion made of a soft ferromagnetic material and an outer portion made of a superconductive sheath. This magnet iron structure traps enhanced flux in the soft ferromagnetic inner portion by the enclosing outer superconductive sheath.

One problem with the prior art trapped flux, magnet iron structure is that it is difficult to trap flux, which is directed in different directions in different parts of a complex arrangement.

Another problem with the prior art trapped flux, magnet iron structure is that the flux is only trapped by the sheath, and is free to wander and bunch within the boundary of the sheath or the superconductive bounded region, which causes a "sponginess" of force, and reaction, and torque, in various applications.

One object of the present invention is to provide a trapped flux, magnet iron structure, which has an improved flux distribution.

Another object is to provide a trapped flux, magnet iron structure which is not difficult to use in a complex arrangement or application, and which does not have a "sponginess" in its force and reaction and torque in an application.

SUMMARY OF THE INVENTION

According to the present invention, a trapped flux, magnet iron structure is provided. This structure includes an axis and includes a plurality of peripherally spaced subassemblies, each said subassembly including one or more elongate ferromagnetic rods, each elongate rod having a superconductive sheath.

By using the plurality of rods with respective sheaths, the flux lines are prevented from moving transverse to the axis, and the flux lines are held in their positions within their sheaths, thereby providing an iron structure which has an even flux distribution, and which avoids "sponginess" in its force and reaction and torque.

By using the separate superconductive sheaths and rods made of a passive ferromagnetic material, such as a perm alloy, or permendor, or gadolinium material, the flux lines are fixed in place, thereby providing a relatively higher level of saturation magnetization.

BRIEF DESCRIPTION OF THE DRAWINGS

The foregoing and other objects, features and advantages will be apparent from the following description of the preferred embodiments of the invention as illustrated in the accompanying drawings.

DESCRIPTION OF THE PREFERRED EMBODIMENTS

Figure 1:
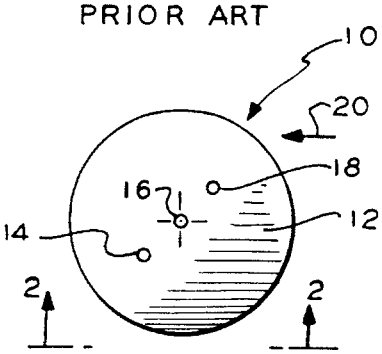
FIG. 1 PRIOR ART
FIG. 1 is a top view of a first, prior art, true permanent magnet iron structure.
Figure 2:
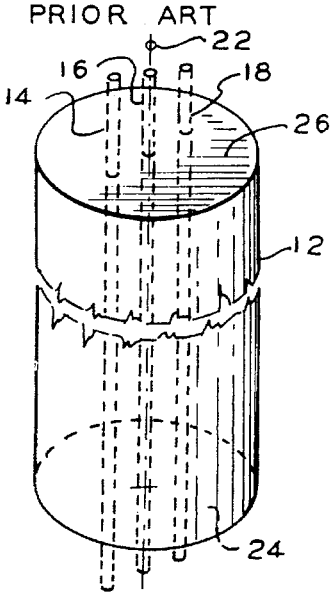
FIG. 2 PRIOR ART
FIG. 2 is an elevation view as taken along the line 2—2 of FIG. 1.

As shown in FIGS. 1 and 2, a first prior art, magnet iron structure, or true permanently magnetic bar structure 10 has a cylindrical body 12. Structure 10 has a plurality of schematically shown flux lines 14, 16, 18, which do not move upon the application of a force 20, that is shown directed towards the left. Body 12 has a conventional construction and material, and has an axis 22. Body 12 also has a bottom face 24 and a top face 26, each face being shown sloped about a line normal to axis 22, for ease of illustration. The flux lines 14, 16, 18 do not move transversely upon the application of force 20. The three flux lines 14, 16, 18 are used to represent a relatively large number of flux lines, for ease of illustration.

Figure 3:
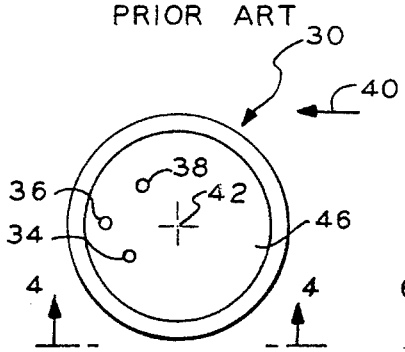
FIG. 3 PRIOR ART
FIG. 3 is a top view of a second, prior art, trapped flux, magnet iron structure.
Figure 4:
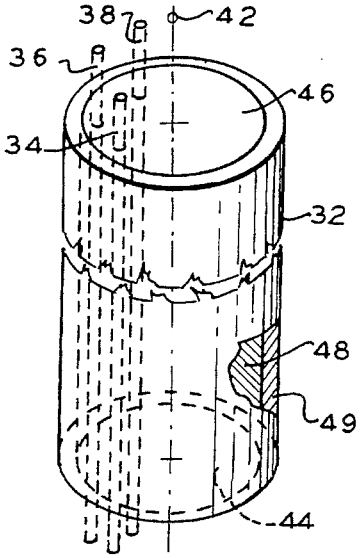
FIG. 4 PRIOR ART
FIG. 4 is an elevation view as taken along the line 4—4 of FIG. 3.

As shown in FIGS. 3 and 4, a second prior art, trapped flux, magnet iron structure 30 also has a cylindrical body 32. Structure 30 has a plurality of flux lines 34, 36, 38, which move to the left upon the application of a force 40, that is directed to the left. Body 32 has an axis 42, and has bottom face 44 and top face 46, each of which is inclined or sloped about a line normal to axis 42, for ease of illustration. Body 32 also includes an inner portion 48, which is made, or formed, from a relatively soft ferromagnetic material, and includes an outer cover or superconductive cladding 49. The flux lines 34, 36, 38 are trapped within the outer cover 49. Flux lines 34, 36, 38 are displaced transverse to axis 42, upon the application of force 46, so that flux lines 34, 36, 38 move to the left and bunch together in a non-uniform arrangement. The bunched flux lines 34, 36, 38 do not give an even flux distribution, and cause a "sponginess" in the body's reaction in various applications. Inner portion 48 is composed of gadolinium or like soft ferromagnetic material. Outer cover 49 is a superconductive sheath. Structure 30 is also described in the above mentioned U.S. Patent, which is incorporated herein by reference.

Figure 5:
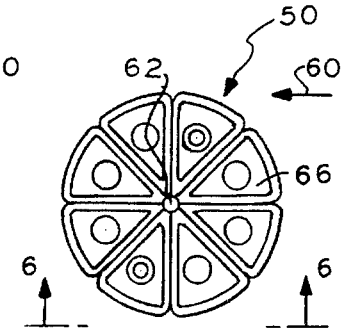
FIG. 5 is a top view of a first embodiment of a trapped flux, magnet iron structure according to the invention.
Figure 6:
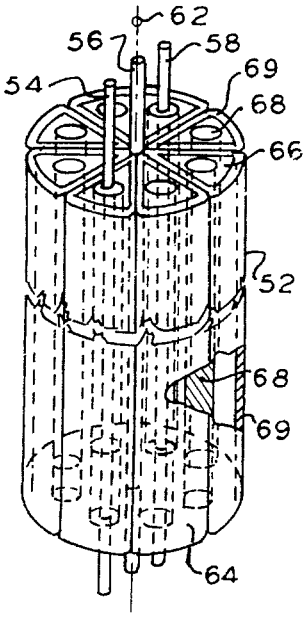
FIG. 6 is an elevation view as taken along the line 6—6 of FIG. 5.

As shown in FIGS. 5 and 6, a trapped flux, magnet iron or bar structure or first embodiment 50, according to the present invention, is provided. Structure or first embodiment 50 has a body 52 of cylindrical shape. Structure 50 also has a plurality of flux lines 54, 56, 58. Flux lines 54, 56, 58 do not move upon the application of a force 60, directed to the left. In this respect embodiment 50 acts like embodiment 10, but not like embodiment 30. Body 52 has an axis 62; and has a bottom face 64 and a top face 66, each of which is sloped about a respective line normal to axis 62 for ease of illustration.

Body 52 also has eight elongate rods or elements 68; and has eight respective covers or sheaths 69. Rods 68 are equiangularly spaced about axis 62. Cover 69 is a superconductive cover. Each rod 68 and its superconductive cover 69 is a subassembly, which may have a connector (not shown) to its adjacent assemblies, such as a ring, a cord, an adhesive, or the like. Rods 68 are relatively small in diameter; and cover 69 is a superconductive type of sheath. Flux lines 54, 56, 58 do not move transversely due to force 60. Flux lines 54, 56, 58 do not bunch together due to the respective separate covers 69. Structure 50 has an even flux distribution, and corresponds in this respect to embodiment 10. Thus, device 50 is a trapped flux, magnet iron structure, which has an even flux distribution. Rods 68 are composed of gadolinium or a like soft magnetic material. Covers 69 are superconductive sheaths.

Figure 7:
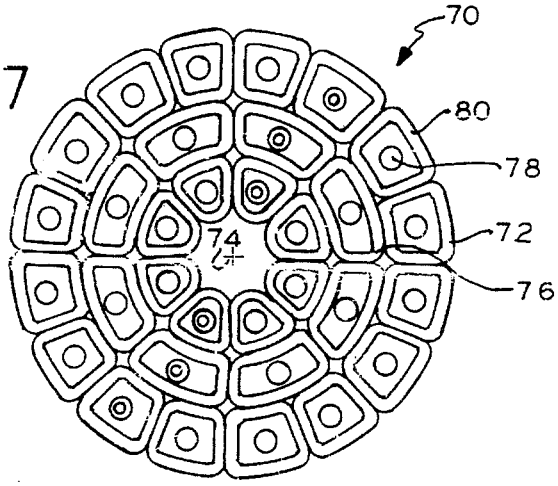
FIG. 7 is a top view of a second embodiment of a trapped flux, magnet iron structure according to the invention.

As shown in FIG. 7, there is provided a second embodiment of a trapped flux, magnet iron structure 70 according to the invention. Structure 70 has a body 72, which has an axis 74. Body 72 has a top face 76, which is inclined. Body 72 has thirty-two rods 78. Rods 78 have thirty-two respective superconductive covers 80. The smaller the rods 78, the more even is the flux distribution. The rods 78 of this second embodiment 70 have a relatively smaller diameter than the rods of first embodiment 50.

The advantages of structures 50 (and 70) are indicated hereafter.

A) Flux lines 54, 56, 58 in structure 50 can be trapped within the regions bounded by the respective rod covers 69, thereby providing an even flux distribution, and thereby preventing flux line bunching along one side of structure axis 62.

B) Elongate structure 50 can be bent into a shape suited for a particular arrangement, and can be used in different parts of a complex arrangement; and each flux line will remain trapped adjacent to its rod 68 and within its respective cover 69.

C) Structure 50 can achieve a higher level of saturation magnetization due to its fixed flux lines.

D) Structure 50 permits the construction of relatively strong magnet configurations of arbitrary shape.

E) Structure 50 permits the use of iron material and similar passive ferromagnetic materials, such as permalloy, permendur, gadolinium, and the like.

F) Structure 50 has a relatively strong ability to retain magnetization in the face of thermal agitation and demagnetizing fields.

While the invention has been described in its preferred embodiments, it is to be understood that the words which have been used are words of description rather than limitation and that changes may be made within the purview of the appended claims without departing from the true scope and spirit of the invention in its broader aspects.

The subassembly of rod 68 and cover 69 can be made as a bundle, or can have a square, or round, or other like cross section.

Structure 50 can be bent into a selective shape, in order to suit a complex apparatus.

What is claimed is:

1. A trapped permanent magnetic flux source formed from a magnetic passive ferromagnet structure comprising:

a plurality of peripherally spaced rods of passive ferromagnetic material, the rods being radially displaced about a central axis;

each rod having a separate superconductive cover wherein the rods and superconducting covers are exposed to a magnetic source when the superconducting covers are in a nonsuperconducting state and then the superconducting covers are cooled to below a superconducting critical temperature such that the respective superconductive covers trap respective magnetic flux within a respective region between the rod and the rods' superconductive cover, wherein the magnetic flux between the rods and the superconductive covers stays at a constant magnitude and position while the superconducting covers are cooled to below the superconducting critical temperature.

2. The iron structure of claim 1, wherein the rods are flexible elongate rods.

3. The iron structure of claim 1, including connecting means for joining together the subassemblies of rods and their covers.

4. The iron structure of claim 1, wherein the subassemblies of rods and covers are alike in shape and structure.

5. The iron structure of claim 1, wherein the subassemblies of rods and covers are peripherally spaced at equal angles.

* * * * *